US009314405B2

(12) United States Patent
Smith

(10) Patent No.: US 9,314,405 B2
(45) Date of Patent: Apr. 19, 2016

(54) MULTIPLE PILL CUTTER

(71) Applicant: Teresa Y. Smith, Union City, IN (US)

(72) Inventor: Teresa Y. Smith, Union City, IN (US)

( * ) Notice: Subject to any disclaimer, the term of this patent is extended or adjusted under 35 U.S.C. 154(b) by 206 days.

(21) Appl. No.: 14/215,334

(22) Filed: Mar. 17, 2014

(65) Prior Publication Data

US 2015/0257978 A1 Sep. 17, 2015

(51) Int. Cl.

| | |
|---|---|
| ***B26F 3/00*** | (2006.01) |
| ***B65H 35/00*** | (2006.01) |
| ***B26D 7/06*** | (2006.01) |
| ***A61J 7/00*** | (2006.01) |
| ***B26D 3/30*** | (2006.01) |
| ***B26D 7/01*** | (2006.01) |

(52) U.S. Cl.

CPC ..... *A61J 7/0007* (2013.01); *B26D 3/30* (2013.01); *B26D 7/01* (2013.01); *Y10T 225/371* (2015.04)

(58) Field of Classification Search

CPC ..... A61J 7/0007; B26D 3/30; B26D 7/01; Y10T 225/371

USPC ..... 83/397, 544, 605–607, 609, 673, 675, 83/398, 497, 450; 220/254.3, 254.6, 220/254.9, 811, 812, 813, 810, 345.1, 351; 225/103–105

See application file for complete search history.

(56) References Cited

U.S. PATENT DOCUMENTS

| | | | | | |
|---|---|---|---|---|---|
| 3,094,007 | A * | 6/1963 | Luhrs | A47B 1/10 | 108/87 |
| 3,683,985 | A * | 8/1972 | Verhoeven | B26D 7/34 | 83/221 |
| 3,807,095 | A * | 4/1974 | Harding | B23D 47/025 | 125/13.03 |
| 3,822,627 | A * | 7/1974 | Bianchi | B26F 1/40 | 83/529 |
| 4,035,990 | A * | 7/1977 | Hallam | B65B 11/48 | 53/222 |
| 4,199,863 | A * | 4/1980 | Deckert | A61J 7/0007 | 30/124 |
| 4,995,225 | A * | 2/1991 | Terminella | B65B 61/28 | 53/222 |
| 6,158,315 | A * | 12/2000 | Nowotny | A21C 3/06 | 83/102 |
| 6,488,192 | B1 * | 12/2002 | Yuyama | B26D 3/30 | 225/103 |
| 6,557,945 | B1 * | 5/2003 | Eric | A61J 7/0007 | 30/124 |
| 8,590,164 | B2 * | 11/2013 | Noble | A61J 7/0007 | 225/104 |
| 8,967,011 | B2 * | 3/2015 | Lee | B60R 11/02 | 74/425 |
| 2003/0001363 | A1 * | 1/2003 | Battistella | A63C 9/003 | 280/618 |
| 2009/0183373 | A1 * | 7/2009 | Suhr | A61J 7/0007 | 30/124 |
| 2013/0247731 | A1 * | 9/2013 | Kim | A61J 7/0007 | 83/109 |

* cited by examiner

*Primary Examiner* — Ghassem Alie
*Assistant Examiner* — Bharat C Patel
(74) *Attorney, Agent, or Firm* — Christopher J. McKenna; Daniel E. Rose; Foley & Lardner LLP

(57) ABSTRACT

A multiple pill cutter provides an individual the ability to cut multiple pills simultaneously. The multiple pill cutter can include a pill cutting bed on which pills can be placed. The multiple pill cutter can further include pill retainers that allow the individual to place and align multiple pills on the cutting bed. The pill cutting bed and the pill retainers can be housed within a lower portion. The multiple pill cutter can also include a top portion, one end of which is hinged to one end of the lower portion. An inner surface of the top portion can include a cutting blade for cutting pills placed on the cutting bed. The cutting blade is positioned such that when the top portion is lowered over the lower portion, the cutting edge of the cutting blade cuts through the multiple pills placed on the cutting bed between the pill retainers.

13 Claims, 7 Drawing Sheets

MULTIPLE PILL CUTTER

TECHNICAL FIELD

This disclosure relates to the field of pill cutters, and in particular, to pill cutters capable of cutting multiple pills with one action.

BACKGROUND

To meet dosage requirements, many individuals need to split or cut in half their pills or medication. In some instances, splitting or cutting the pills by hand, such as with a knife or razor blade, is difficult or cumbersome due to the small size and rigidness of the pills, and may result in accidents and injuries, destruction of pills or uneven division, loss of pills, etc.

SUMMARY

To aid with cutting or dividing one or more pills simultaneously or with one action, a multiple pill cutting may be provided, said pill cutting device comprising one or more pill retainers, a cutting bed, a cutting blade positioned in a centered position above the cutting bed, and a mechanism for bringing the cutting blade in contact with the cutting bed, such as a lever or hinge. A user may place one or more pills within the cutting bed and position one or more pill retainers to securely fix the one or more pills beneath the cutting blade. The user may then activate the mechanism, dividing the one or more pills, while retaining the pill halves. Accordingly, the user may easily divide a plurality of pills in a controlled fashion, without fear of injury or destruction of medication.

The systems, methods and devices of the disclosure each have several innovative aspects, no single one of which is solely responsible for the desirable attributes disclosed herein.

One innovative aspect of the subject matter described in this disclosure can be implemented in a multiple pill cutting device, including a lower portion having a cutting bed, a first pill retainer, and a second pill retainer parallel to the first pill retainer, an upper portion pivotally attached to the lower portion, and a pill cutting blade attached to the upper portion.

In some implementations, the pill cutting blade is centered within the upper portion. In some implementations, the first pill retainer includes a linear gear, and the multiple pill cutting device further includes a pinion gear configured to engage the linear gear of the first pill retainer. In some implementations, the second pill retainer includes a second linear gear, oriented in opposition to the linear gear of the first pill retainer, and configured to engage the pinion gear at a point 180 degrees from the linear gear of the first pill retainer.

In some implementations, the first pill retainer is longer than the second pill retainer. In some implementations, the first pill retainer extends beyond the second linear gear of the second pill retainer. In some implementations, the lower portion further includes an axle attached to the pinion gear. In some implementations, the multiple pill cutting device further includes a closing lever attached to the axle. In some implementations, the axle extends at least the length of the cutting bed.

In some implementations, the pinion gear is positioned at one end of the cutting bed; and further comprising a second pinion gear attached to the axle at an opposing end of the cutting bed. In some implementations, the first pill retainer includes a third linear gear configured to engage the second pinion gear. In some implementations, the second pill retainer comprises a fourth linear gear, oriented in opposition to the third linear gear of the first pill retainer, and configured to engage the second pinion gear at a point 180 degrees from the linear gear of the first pill retainer. In some implementations, the cutting bed includes a rubberized material.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

A multiple pill cutter provides an individual the ability to cut multiple pills simultaneously or near simultaneously, via one action from the individual (e.g. closing a lever or hinge, pressing a button, etc.). The multiple pill cutter can include a pill cutting bed on which pills can be placed. The multiple pill cutter can further include pill retainers that allow the individual to place and align multiple pills on the cutting bed. The pill cutting bed and the pill retainers can be housed within a lower portion. The multiple pill cutter can also include a top portion, one end of which is hinged to one end of the lower portion. An inner surface of the top portion can include a cutting blade for cutting pills placed on the cutting bed. The cutting blade is positioned such that when the top portion is lowered over the lower portion, the cutting edge of the cutting blade cuts through one or more pills placed on the cutting bed between the pill retainers.

Particular implementations of the subject matter described in this disclosure can be implemented to realize one or more of the following potential advantages. The multiple pill cutter can cut multiple pills in a single cutting operation. Furthermore, having adjustable pill retainers can allow the individual to secure and cut pills of various sizes. The adjustable pill retainers are configured such that the pills can be positioned to be cut substantially in half, regardless of their size.

Figure 1:
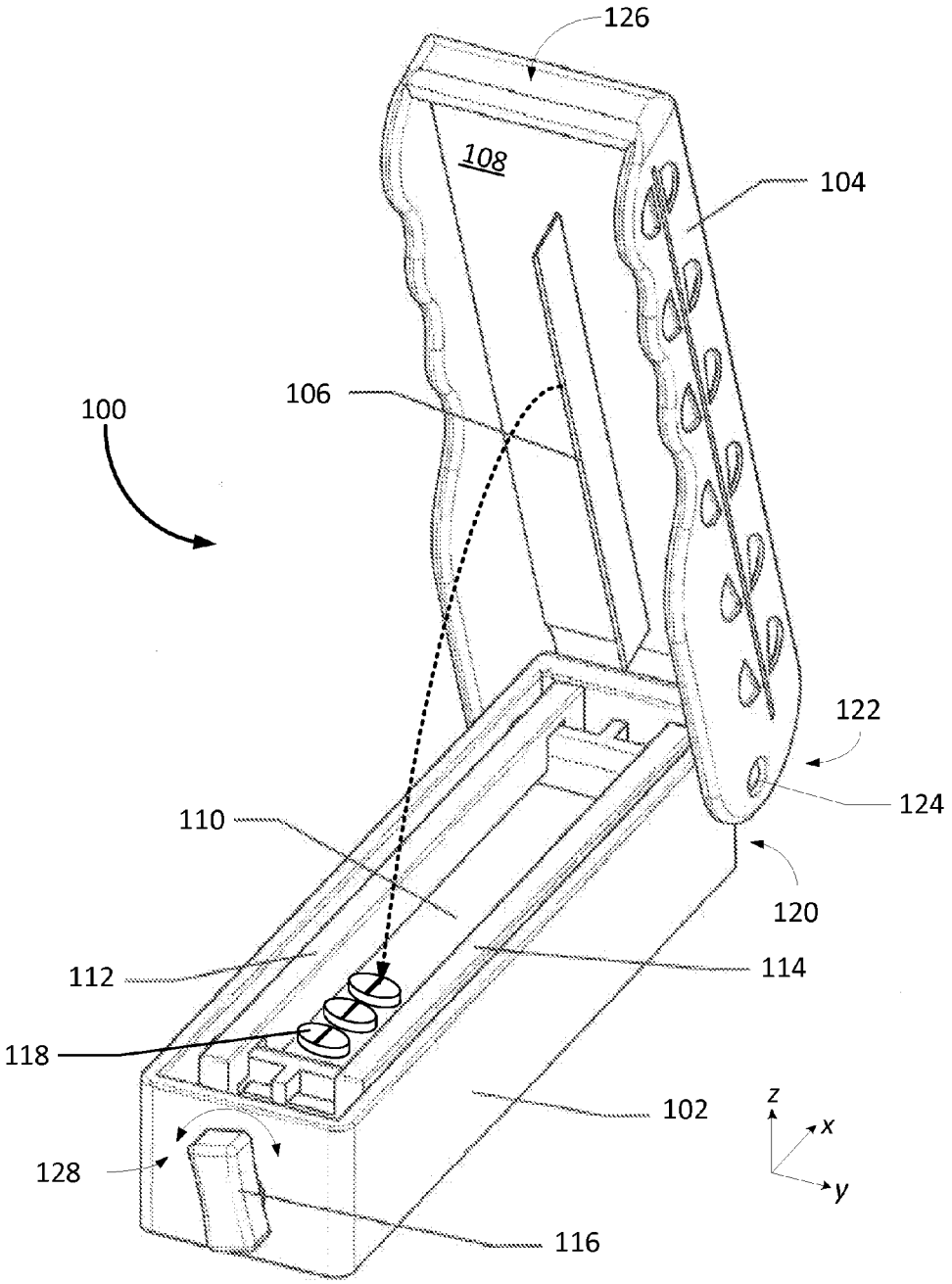
FIG. 1 is a perspective view of an implementation of a multiple pill cutting device.

FIG. 1 is a perspective view of an implementation of a multiple pill cutting device 100. In particular, FIG. 1 shows a pill cutting device 100 that can be employed for cutting multiple pills in a single cutting operation. The pill cutting device 100 includes a lower portion 102, and a top portion 104 pivotally attached to the lower portion 102, a cutting blade 106 attached to an inner surface 108 of the top portion 104, and a cutting bed 110. In some implementations, the pill cutting device 100 may include one or more fixed or adjustable pill retainers, such as a first pill retainer 112, a second pill retainer 114 as shown. In some implementations in which the pill cutting device 100 includes one or more adjustable pill retainers, the pill cutting device 100 may include and a dial 116. The cutting bed 110 can accommodate one or more pills, such as pills 118, which a user desires to cut.

In some implementations as shown, a first end 120 of the lower portion 102 is pivotally engaged with a first end 122 of the top portion 104 at hinge 124. A second end 126 of the top portion 104, opposing the first end 122, can be lowered or raised in along and arc with respect to an axis formed at the hinge 124. For example, the top portion 104, or in particular the second end 126 of the top portion 104, can be held by a user's hand and lowered such that the second end 126 of the top portion 104 mates with a second end 128 of the lower portion 102. In other implementations, other mechanisms may be used to lower the top portion 104 or a cutting blade 106 connected to the top portion 104 into contact with the lower portion 102 or a cutting bed 110. For example, the top portion 104 may be wholly removable and not pivotally attached; rather, the user may nest the two portions 102, 104 against or within each other to cut pills. In a similar embodiment, the top portion 104 may be slidingly coupled to the lower portion 102. For example, the top portion 104 may be slid in a direction orthogonal to a cutting direction; e.g. slid to one side or another to allow the user to place pills within the cutting bed, then returned to position above the bottom portion 102 and pressed downwards to divide the pills.

In some embodiments, the cutting blade 106 is disposed on the inner surface 108 of the top portion 104 substantially centered along the smaller dimension of the top portion 104. The cutting blade 106 is also disposed substantially parallel to the edges along the longer dimension of the top portion 104. Furthermore, the cutting blade 106 is disposed such that when the top portion 104 is lowered, the cutting blade 106 is substantially centered along the longer dimension of the cutting bed 110. In other embodiments, the cutting blade 106 may be positioned elsewhere, such as on a corresponding portion of the bottom portion 102. For example, in one such embodiment, the cutting blade 106 may be positioned beneath a longitudinal slot in the cutting bed, which may be slidingly attached to the bottom portion 102 such that when the user presses the top portion against the bottom portion, the cutting bed is translated downwards, exposing the cutting blade and dividing the pills from beneath.

As mentioned above, in some embodiments, the lower portion 102 houses the cutting bed 110 and the first and second pill retainers 112 and 114. The cutting bed 110, and the first and the second retainers 112 and 114 are engaged in a manner to allow retaining pills 118 securely on the cutting bed 110. In other embodiments, as discussed above, the cutting bed may comprise a portion of the top portion; e.g. in embodiments in which the cutting blade is exposed from below to cut pills against a cutting bed in the top portion. A knob 116, disposed at the second end 128 of the lower portion, may be attached to a shaft (not shown) that is coupled with gear mechanism (not shown) associated with the first and second retainers 112 and 114 (the shaft and the gear mechanism is discussed in detail below with reference to FIG. 7). The knob 116 can be turned in a clockwise or in an anti-clockwise direction (e.g., centered around the x-axis). In some implementations, turning the knob 116 in one direction imparts motion to both the first and the second retainers 112 and 114 such that the first and the second retainers 112 and 114 are slidably drawn towards each other. On the other hand, turning the knob 116 in the opposite direction imparts a motion in the opposite direction in the first and the second retainers 112 and 114 such that the first and the second retainers 112 and 114 are slidably drawn away from each other. In other embodiments, a lever, thumbscrew, or similar mechanism may be used to reposition the first and second retainers 112, 114. In still other embodiments, no mechanism may be included; rather, a user may manually position the first and second retainers 112, 114, such as in notches or grooves based on predetermined pill diameters. In yet still other embodiments, a first retainer may be fixed and another retainer may be moved in relation to the first retainer to adjust for different pill diameters. In such embodiments, the cutting bed and/or cutting blade may also move with the adjustable retainer such that the cutting location remains centered between the retainers.

To cut one or more pills, a user can place the pills 118 over the cutting bed 110. The pills 118 can be positioned over the cutting bed 110 such that the direction of the cut desired is substantially parallel to an edge along the length of the lower portion 102. In some implementations, the initial positions of the first and the second retainers 112 and 114 may be such that the distance between them may be too small to accommodate the size of the pills 118. In some such instances, the user may turn the knob or other mechanism 116 in the appropriate direction to pull the first and the second retainers 112 and 114 apart so as to increase the distance between them. Thereafter, the user can place the pills 116 on the cutting bed 110.

After placing the desired number of pills 118 over the cutting bed 110, the user can turn the knob 116 or other mechanism such that the first and the second retainers 112 and 114 are pulled towards each other. The user can continue turning the knob 116 up to a point where the motion of the first and the second retainers 112 and 114 is impeded by the pills 118. At this point, the knob 116 may offer resistance to the user's attempt to rotate the knob 116 any further. This can indicate to the user that the pills 118 have been secured, and that they are ready to be cut. In other implementations, such as where a lever is used to reposition first and second retainers 112, 114, the user may encounter increased resistance while manipulating the lever, indicating that the pills are securely retained.

The user can then proceed with lowering the second end 126 of the top portion 104 toward the second end 128 of the lower portion. The lowering of the top portion 104, in turn, lowers the cutting blade 106 towards the pills 118 secured between the first and the second retainers 114 and 116. At a certain point in the lowering of the top portion 104 toward the lower portion 102, the cutting blade 106 may come in contact with the pills 118. Additional lowering force (or torque) provided by the user to the top portion 104 may cause the cutting blade 106 to cut through the pills 118. The user can continue to lower the top portion 104 until the cutting blade 106 cuts through the pills 118 and comes in contact with the cutting bed 110. As discussed above, in other implementations, the user may press the top portion against the bottom portion, moving a sliding cutting bed that exposes a cutting blade from beneath and cutting through pills 118.

Subsequently, the user can lift the top portion 104 such that the second end 126 of the top portion 104 is pulled away from the second end 128 of the lower portion 102. The user can then turn the knob 116 in the opposite direction such that the first and the second retainers 112 and 114 are pulled away from each other. This results in the pills 118, which have been cut by the cutting blade 106, to be released and be in a position to be readily retrieved by the user.

While FIG. 1 shows the pills 118 being disposed on the cutting bed 110 closer to the second end 128 of the lower portion 102 than to the first end 120 of the lower portion 102, it is understood that the pills 118 could be disposed at any position along the length of the cutting bed 110. In some implementations, the entire length of the cutting bed 110 (from near the first end 120 to near the second end 128 of the lower portion 102) can be populated with pills 118.

Figure 2:
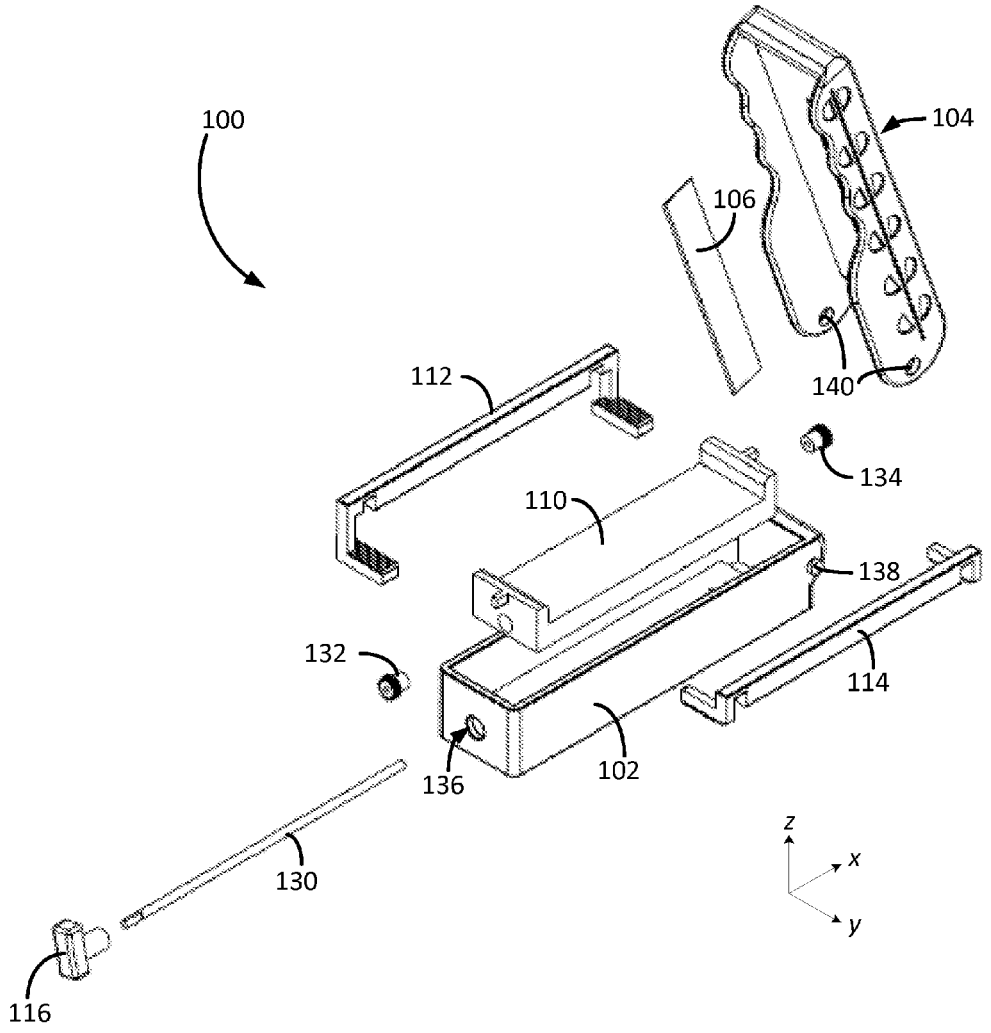
FIG. 2 is an exploded view of an implementation of a multiple pill cutting device, as shown in FIG. 1.

FIG. 2 shows an exploded view of an embodiment of a pill cutting device 100. FIG. 2 shows various components that constitute the pill cutting device 100, such as the lower portion 102, the top portion 104, the cutting blade 106, the cutting bed 110, the first and the second retainers 112 and 114, and the knob 116. In addition, FIG. 2 shows various features of embodiments of pill cutting devices that were not visible or not included in the embodiment of in FIG. 1, such as the shaft 130, a first pinion gear 132, a second pinion gear 134, a knob retaining opening 136 on the lower portion 102, a pair of hinge members 138 (only one of which is visible in FIG. 2) on the side surfaces of the lower portion 104, and a pair of hinge openings 140 on the side surfaces of the top portion 104, which can mate with the pair of hinge members 138. As discussed below in further detail, the shaft 130 is attached to the knob 116. The knob 116, in turn, is retained by the knob retaining opening 136 on the lower portion 102.

Figure 3:
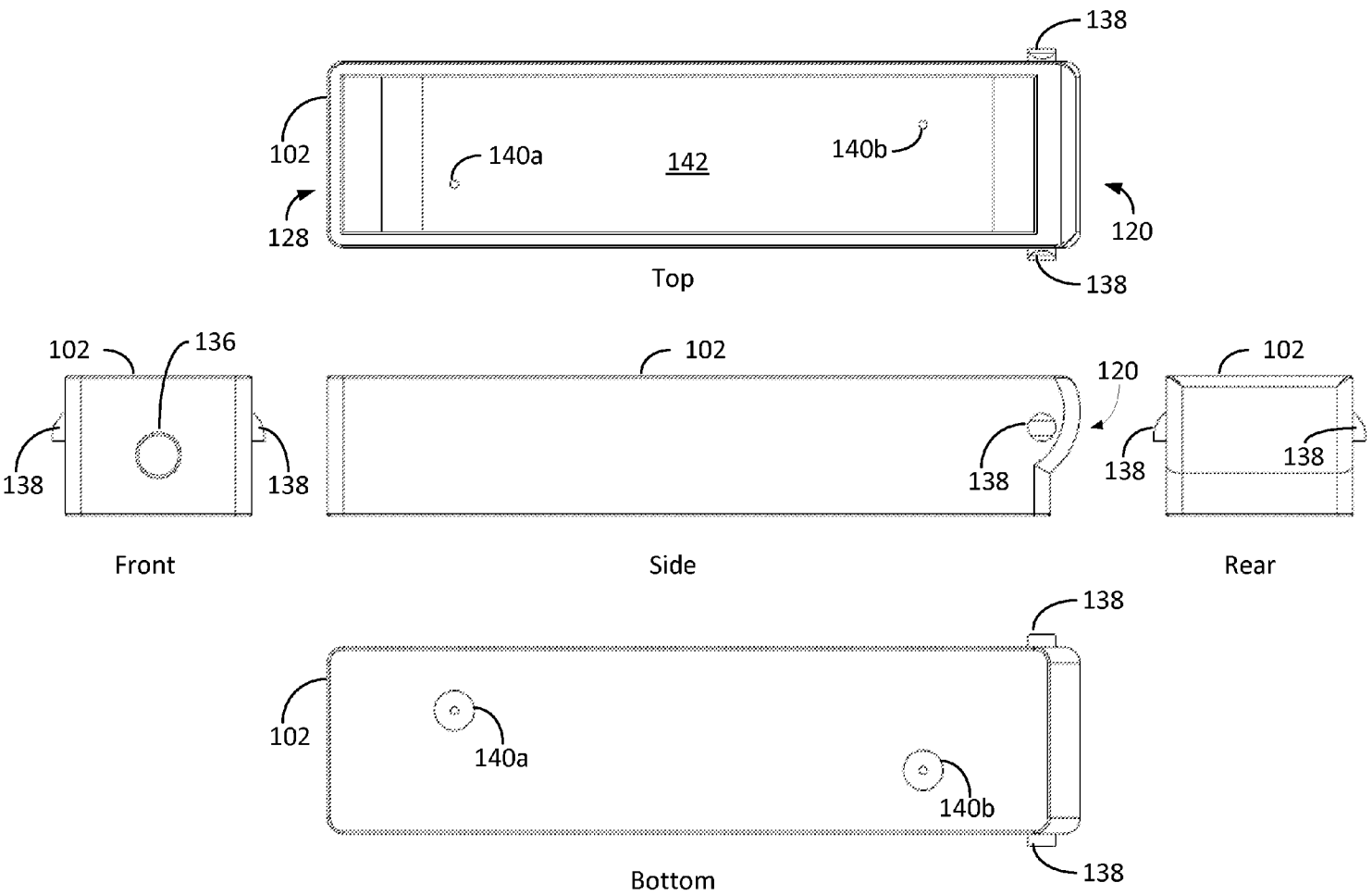
FIG. 3 is a set of diagrams of the front, rear, side, top, and bottom views of a lower portion of a pill cutting device, as shown in FIGS. 1 and 2.
Figure 4:
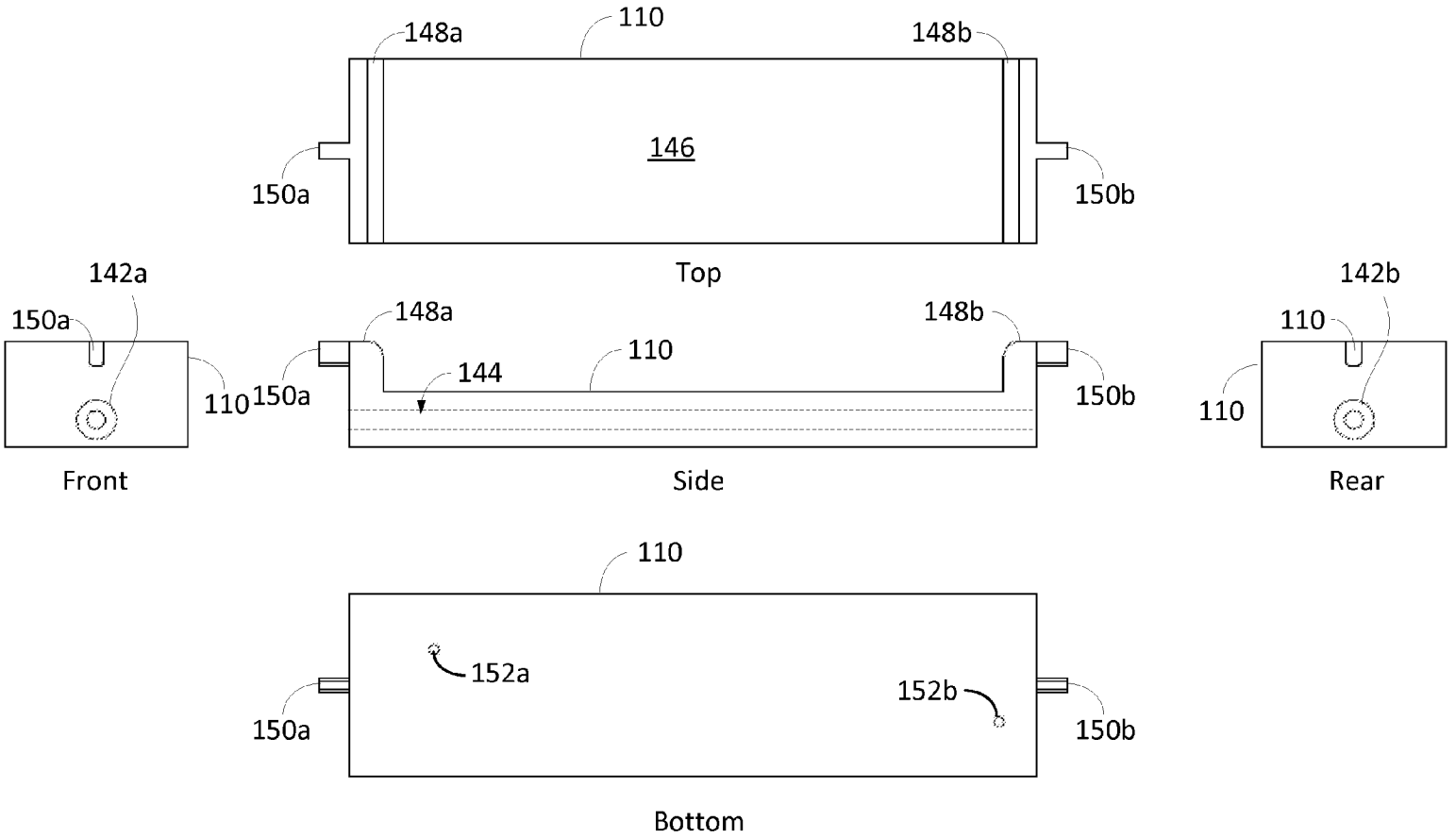
FIG. 4 is a set of diagrams of the front, rear, side, top, and the bottom views of a cutting bed of a pill cutting device, as shown in FIGS. 1 and 2.
Figure 5:
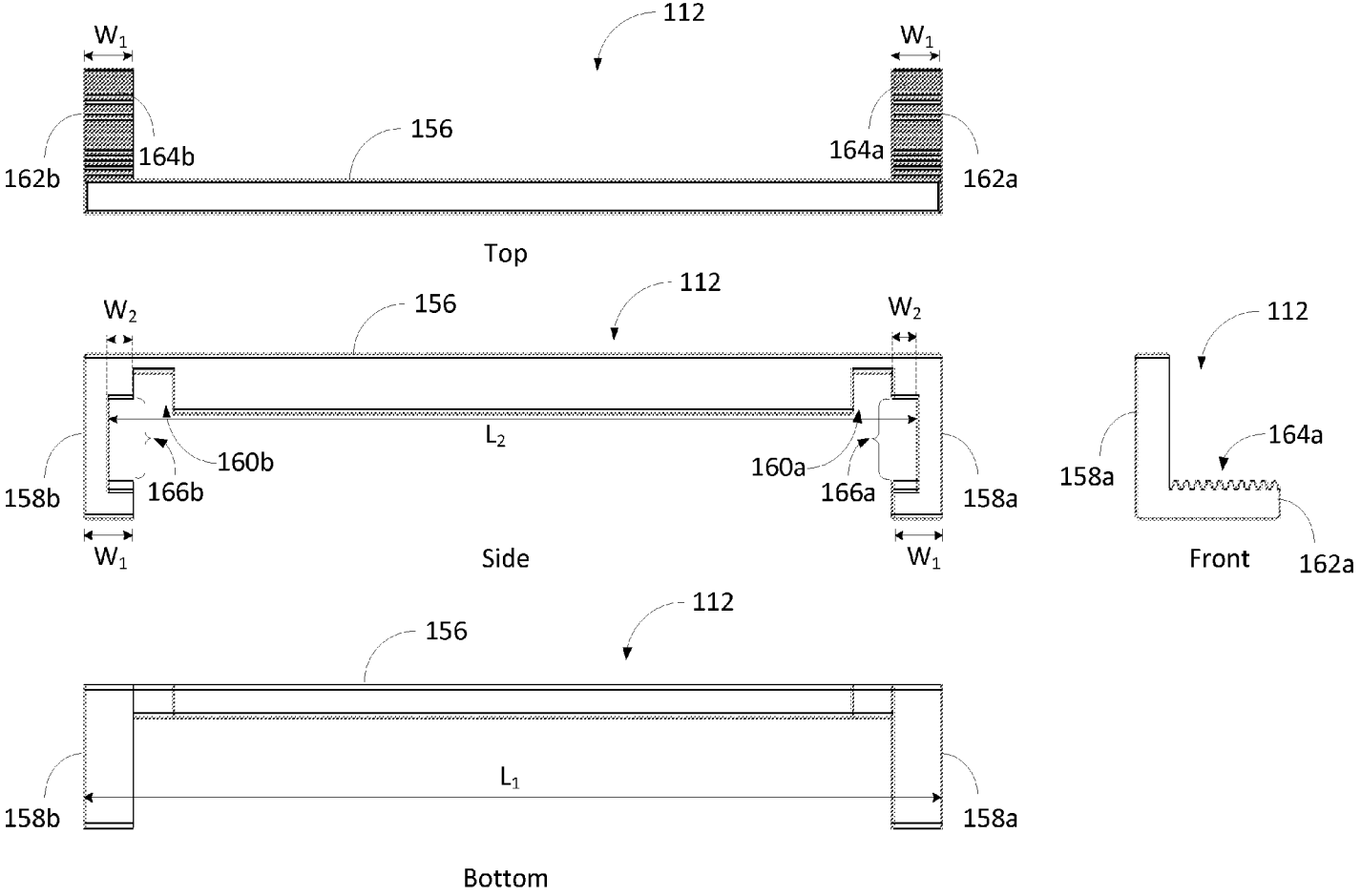
FIG. 5 is a set of diagrams of the top, side, bottom, and front view of a first retainer of a pill cutting device, as shown in FIGS. 1 and 2.
Figure 6:
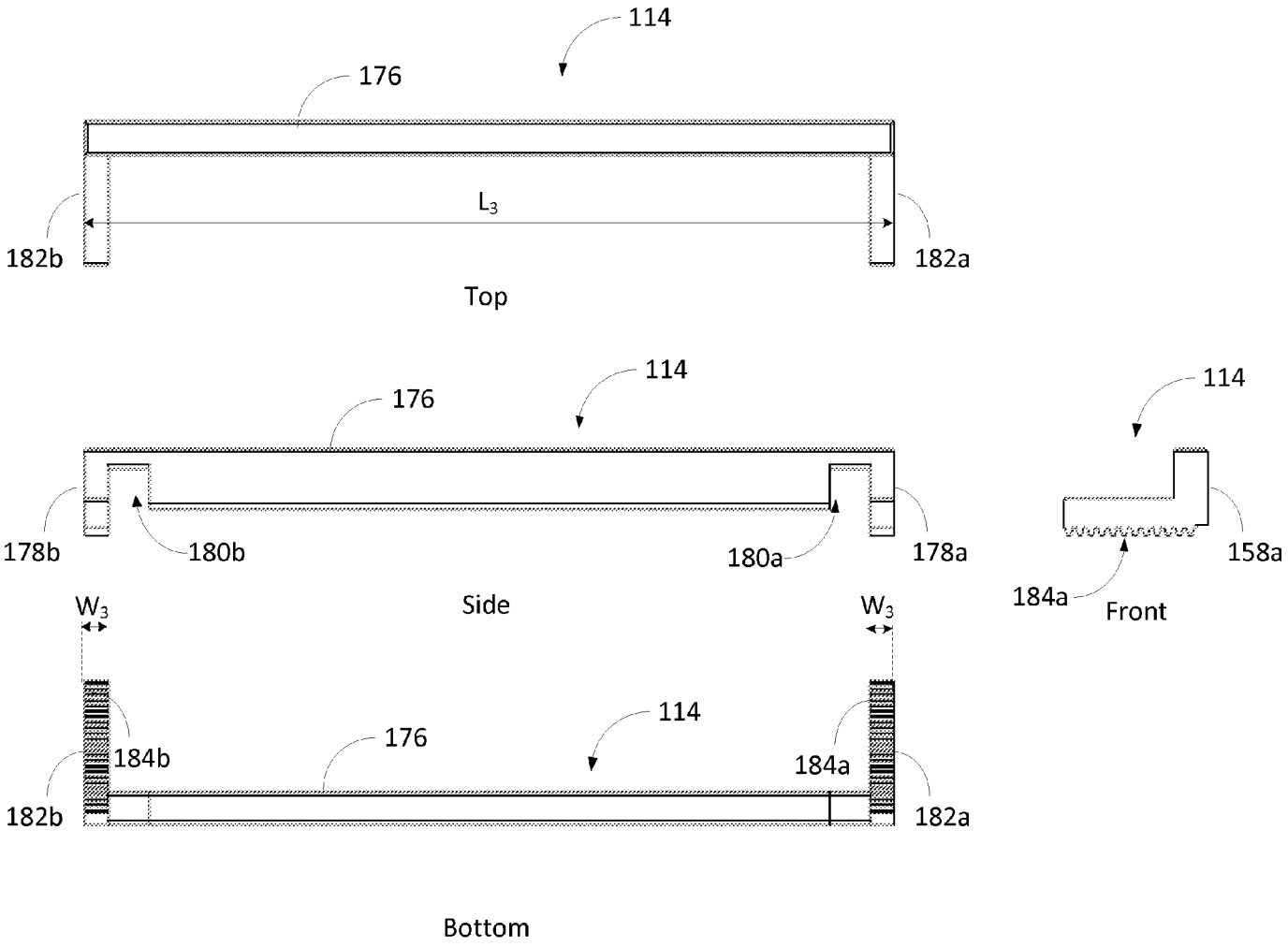
FIG. 6 is a set of diagrams of the top, side, bottom, and front view of a second retainer of a pill cutting device, as shown in FIGS. 1 and 2.

FIG. 3 through FIG. 6 show additional views of various components of embodiments of pill cutting devices 100. FIG. 3 shows various views of embodiments of a lower portion 102. FIG. 4 shows various views of embodiments of a cutting bed 110. FIG. 5 shows various views of embodiments of a first retainer 112, and FIG. 6 shows various views of embodiments of a second retainer 114.

Referring to FIG. 3, illustrated are views of the front, rear, side, top, and bottom of a lower portion 102 of an embodiment of a pill cutting device. The front view corresponds to the view seen in the direction of the positive x-axis as shown in FIG. 2. The front view of the lower portion 102 (as also shown in FIG. 2) shows the knob retaining opening 136. The knob retaining opening 136 has a diameter that is large enough to accommodate the knob 116. Various views of the lower portion 102 also show the pair of hinge members 138 disposed near the first end of the lower portion 102. The pair of hinge members can mate with the pair of hinge openings 140 in the top portion (shown in FIG. 2). In some implementations, the pair of hinge members 138 may have a sloping profile to allow the top portion 104 to easily slide downwards on the outside of the hinge members 138 until the hinge members 138 are engaged within the respective hinge openings 140, for easy assembly/disassembly during manufacture or for cleaning. The top view of the lower portion 102 also shows two dowels 140*a* and 140*b* disposed over an inner surface 142 of the lower portion 102, which may be present in some embodiments. In such embodiments, the dowels 140*a* and 140*b* can received by corresponding holes located on the bottom surface of a cutting bed 110 (shown in FIG. 4). The dowels 140*a* and 140*b* when engaged with the holes in the cutting bed 110 prevent undue lateral movement of the cutting bed 110 during the operation of the cutting device 100, while still allowing easy disassembly for cleaning.

FIG. 4 shows the front, rear, side, top, and the bottom views of a cutting bed 110 in embodiments of a pill cutting device. The front view corresponds to the view seen in the direction of the positive x-axis (axis shown in FIG. 2). As shown in the front view of FIG. 4, the cutting bed 110 may include a first shaft opening 142*a* formed in the side of the cutting bed 110 facing the inner side of the second end 128 of the lower portion 102. The first shaft opening 142*a* forms one end of a shaft passage 144 (shown in broken lines in the side view), the other end of which is formed by the second shaft opening 142*b* over the rear of the cutting bed. The shaft passage 144 allows a shaft 130 (such as shaft 130 shown in FIG. 2) to pass through the shaft passage 144 and extend out from the first and the second shaft openings 142*a* and 142*b*. In some implementations, the first shaft opening 142*a* is disposed on the front of the cutting bed 110 such that when the cutting bed 110 is placed within the lower portion, the first shaft opening 142*a* is substantially coaxial in relation with the knob retaining opening 136. The coaxial relationship ensures that the shaft 130, which is attached to the knob 116, is able to pass through the shaft passage 144. In other implementations, as discussed above, other mechanisms may be used for positioning the first and second retainer, and accordingly, a shaft 130 may not be utilized.

As shown in the top view, the cutting bed 110 may include a top surface 146, over which the pills 118 (shown in FIG. 1) can be placed. In some implementations, the top surface can be coated with a material that is different from the material used to form the cutting bed 110. In some implementations, a rubberized material may be used to form the top surface 146, e.g. rubber, silicon, polypropylene, etc. A rubberized top surface 146 can provide a high friction surface, which can minimize the movement of the pills 118 during the cutting operation. In other implementations, the top surface 146 may not be rubberized, and the pills may be securely retained by the first and second retainer as discussed above. In some implementations, the top surface 146 may over time become damaged due to repeated contact with the cutting blade 106 during cutting operations. In some such implementations, the top surface 146 can be removable and replaceable. For example, the top surface 146 could be adhered to the cutting bed 110 with an adhesive such that, when desired, the top surface 146 could be peeled off the cutting bed 110 and replaced with a replacement top surface. In other implementations, the entire cutting bed may be replaced. In still other implementations, the top surface 146 may be of sufficient hardness to resist damage during cutting operations, e.g. glass, transparent aluminum (sapphire), etc. In still other embodiments, the top surface may have a longitudinal notch parallel to and disposed beneath the cutting blade, such that when the pill cutter is closed (e.g. during a cutting operation), the cutting blade may extend into the notch and below the surface of the cutting bed adjacent to the notch. In such embodiments, the cutting blade need not contact the bottom of the notch to fully divide a pill. This may reduce wear on the blade. In a further embodiment and as discussed above, the cutting bed may be removable to clean pill remnants, dust, or other materials that are retained within said notch.

The cutting bed 110 may include a pair of rails 148*a* and 148*b* at each end along the length of the cutting bed 110. The rails 148*a* and 148*b* may extend normally upwards (i.e., in the direction of the positive z-axis shown in FIG. 2) from the top surface 146 of the cutting bed 110. As discussed further below, in many implementations, the pair of rails 148*a* and 148*b* may provide a guide over which the first and the second retainers 114 and 116 can slide. The cutting bed 110 may also include a pair of extension members 150*a* and 150*b* that extend normally from the outer walls of the rails 148*a* and 148*b*, respectively. When the cutting bed 110 is positioned within the lower portion 102, the extension members 150*a* and 150*b* extend to abut with the inner surfaces of the second end 128 and the first end 120, respectively. The extension members 150*a* and 150*b* may prevent undesirable movement of the cutting bed 110 along the length of the lower portion 102 during the cutting operation. The cutting bed 110 may also include a pair of dowel receiving holes 152*a* and 152*b* for receiving dowels 140*a* and 140*b*, respectively, when the cutting bed 110 is positioned within the lower portion 102. As mentioned above, the dowel receiving holes 152*a* and 152*b* may be engaged with the dowels 140*a* and 140*b* to allow installation of the cutting bed, and may prevent undue lateral movement of the cutting bed 110 during the operation of the cutting device 100.

FIG. 5 shows the top, side, bottom, and front view of an embodiment of a first retainer 112 of a pill cutting device (the rear view is symmetrical to the front view and is not shown). The front view corresponds to the view seen in the direction of the positive x-axis (axis shown in FIG. 2). The first retainer 112 includes a first retainer wall 156 that extends along the length of the first retainer 112. The first retainer wall 156 provides retaining surface for retaining and securing the pills 118. As shown in the side view, the two ends (along the length of the first retainer wall 156) of the first retainer wall 156 includes a first and second rail grooves 160*a* and 160*b*. The first and second rail grooves 160*a* and 160*b* are disposed on the first retainer wall 156 such that when the first retainer wall 156 is placed over the cutting bed 110, the first and second rail grooves 160*a* and 160*b* engage with the rails 148*a* and 148*b* (shown in FIG. 4), respectively, of the cutting bed 110. As shown, the ends of the first retainer 112 may be symmetrical, easing manufacture.

The first retainer 112 also includes, at its two ends, first and second extension arms 158*a* and 158*b*. The first and the second extension arms 158*a* and 158*b* extend normally from the bottom of the first retainer wall 156 (in the direction of the negative z-axis shown in FIG. 2). The first retainer 112 further includes first and second linear gear arms 162*a* and 162*b* disposed on the first and second extension arms 158*a* and 158*b*, respectively. The first and second linear gear arms 162*a* and 162*b* extend outwards (in the direction of the positive y-axis) from the first and second extension arms 158*a* and 158*b*, respectively. Furthermore, first and second linear gears 164*a* and 164*b* are provided over the top surface of the first and second linear gear arms 162*a* and 162*b*, respectively. The linear gears 164*a* and 164*b* are formed in a manner such that they can effectively engage with first and second pinion gears 132 and 134, respectively, in embodiments employing pinion gears for movement of the first and second retainer. Each of the first and the second linear gears 164*a* and 164*b* can have a width $W_1$. In some implementations, the width $W_1$ can be greater than at least the width of the pinion gears 132 and 134.

The first retainer wall 156, the first extension arm 158*a* and the first linear gear arm 162*a* define a first recess 166*a*. As discussed further below, the first recess 166*a* allows relief to a linear gear arm of the second retainer 114 that can extend within the plane of the first retainer wall 156 during the operation of the pill cutting device 100. The width $W_2$ of the first recess 166*a* is generally at least greater than a width of the linear gear arm of the second retainer 114. A second recess 166*b*, similar to the first recess 166*a* is also formed on the opposite end of the first retainer 112 to provide relief to another linear gear arm of the second retainer 114. The distance between the inner surface of the first recess 166*a* and the inner surface of the second recess 166*b* is indicated by $L_2$. In some implementations, the distance $L_2$ can be at least greater than the length of the second retainer 114.

In some implementations, the length L1 of the first retainer 112 is selected to be less than at least the distance between the inner surfaces of the first and second end 120 and 128 of the lower portion 102. In some implementations, the length $L_1$ can be selected such that the outer surfaces of the first and second linear gear arms 162*a* and 162*b* abut the inner surfaces of the second end 128 and the first end 120 of the lower portion 102.

FIG. 6 shows the top, side, bottom, and front view of an embodiment of a second retainer 114 (the rear view is symmetrical to the front view and is not shown) of a pill cutting device. The front view corresponds to the view seen in the direction of the positive x-axis (axis shown in FIG. 2). The second retainer 114 may include a second retainer wall 176 that extends along the length of the second retainer 114. The second retaining wall 176 provides a retaining surface, opposing the retaining surface provided by the first retaining wall of the first retainer 112, for retaining and securing the pills 118. Similar to the first and second rail grooves 160*a* and 160*b* of the first retainer (shown in FIG. 5), the second retainer includes third and fourth rail grooves 180*a* and 180*b*. The third and fourth rail grooves 180*a* and 180*b* are disposed on the second retainer wall 176 such that when the second retainer wall 176 is placed over the cutting bed, the third and the fourth rail grooves 180*a* and 180*b* engage with the rails 148*a* and 148*b*, respectively, of the cutting bed 110.

The second retainer 176 also includes, at its two ends, third and fourth extension arms 178*a* and 178*b*. The first and second extension arms 178*a* and 178*b* extend normally from the bottom of the second retainer wall 176 (in a direction of the negative z-axis shown in FIG. 2). The second retainer 114 further includes third and fourth linear gear arms 182*a* and 182*b* disposed on the third and fourth extension arms 178*a* and 178*b*, respectively. The third and fourth linear gear arms 182*a* and 182*b* extend outwards (in the direction of the negative y-axis) from the third and the fourth extension arms 178*a* and 178*b*, respectively. Furthermore, third and fourth linear gears 184*a* and 184*b* are provided over the bottom surface of the third and the fourth linear gear arms 182*a* and 182*b*, respectively. The linear gears 184*a* and 184*b* are formed in a manner such that they can effectively engage with the first and second pinion gears 132 and 134, respectively (e.g. have a corresponding gear ratio, tooth depth, etc.). In some implementations, the widths $W_3$ of the third and fourth linear gear arms 182*a* and 182*b* is selected to be no more than the width $W_2$ of the first and second recesses 166*a* and 166*b*. Furthermore, the $W_3$ may be selected to be less than the width $W_1$ of the first and second gear arms 162*a* and 162*b*.

In some embodiments, the length $L_3$ of the second retainer 114 is selected such that it is not greater than the distance $L_2$ (shown in FIG. 5) between the inner surfaces of the first and the second recesses 166*a* and 166*b*. This allows the third and fourth linear gear arms 182*a* and 182*b* to slide within the recesses 166*a* and 166*b* during the operation of the pill cutting device 100. In other embodiments, the orientation of the first retainer and second retainer may be reversed, such that the second retainer is longer than the first retainer, and the gear arms of the first retainer slide within recesses of the second retainer.

Figure 7:
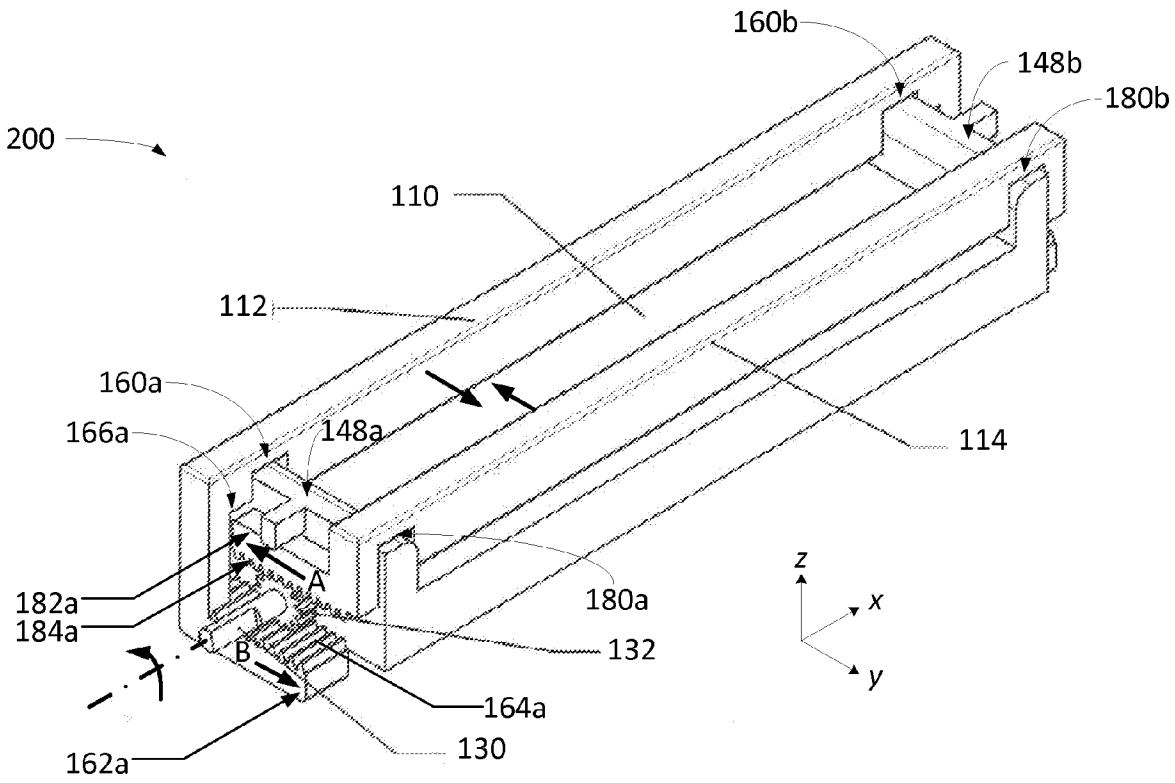
FIG. 7 is a perspective view of an implementation of a pill retaining gear mechanism of a pill cutting device, as shown in FIGS. 1 and 2.

FIG. 7 shows an example pill retaining gear mechanism 200 of an embodiment of a pill cutting device 100. In particular, the gear mechanism 200 includes a cutting bed 110, a first retainer 112, a second retainer 114, a shaft 130, a first pinion gear 132, and, in some embodiments, a second pinion gear 134 (not shown in FIG. 7). In some embodiments, the gear mechanism 200 is placed in the lower portion 102. A first end of the shaft 130 is attached to the knob 112, which in turn is retained within the knob retaining opening 136. Turning the knob 116 imparts rotary motion to the shaft 130. The shaft 130 is passed through the cutting bed 110 (via the shaft passage 144, such as the passage 144 shown in FIG. 4). A shaft 130 may also pass through openings in the first pinion gear 132 and the second pinion gear 134 (not shown), such that the first pinion gear 132 is disposed near the first end of the shaft 130 while the second pinion gear 134 is disposed over the second end of the shaft 130 (only the first end of the shaft 130 and the first pinion gear 132 is visible in FIG. 7).

In embodiments employing the gear mechanism 200, the first pinion gear 132 may be positioned such that the first pinion gear 132 engages with the first linear gear 164*a* of the first retainer 112 and the third linear gear 184*a* of the second retainer 114. Specifically, the first linear gear 164*a* engages with the first pinion gear 132 at a point on the first pinion 132 that is diametrically opposite (or about 180 degrees) to the point on the first pinion 312 where the third linear gear 184*a* engages with the first pinion 132. While not shown in FIG. 7, in some embodiments, at the other end of the shaft 130, a second pinion gear 134 may engage with the second linear gear 164*b* of the first retainer 112 and the fourth linear gear 184*b* of the second retainer 114. The point on the second pinion gear 134 that engages with the second linear gear 164*b* is diametrically opposite (or about 180 degrees) to the point on the second pinion gear 134 that engages with the fourth linear gear 184*b*. In other embodiments, a second pinion gear 134, second linear gear 164*b*, and fourth linear gear 184*b* may not be utilized. This may reduce manufacturing costs in some implementations where the second gear is not needed for stability.

The first retainer 112 is disposed over the cutting bed 110 such that the first and the second rail grooves 160*a* and 160*b* engage with the first and second rails 148*a* and 148*b*, respectively. Similarly, the second retainer 114 is disposed over the cutting bed 110 such that the third and the fourth rail grooves 180*a* and 180*b* engage with the first and second rails 148*a* and 148*b*, respectively.

As discussed above, to securely retain the pills 118 (shown in FIG. 1) between the first and the second retainers 112 and 114, in some embodiments, the user turns the knob 116 such that the first and the second retainers 112 and 114 are pulled toward each other. This motion can be imparted to the first and the second retainer in some embodiments by turning the shaft 130 in the anti-clockwise direction (centered around the x-axis). In other embodiments, orientations of the first and second retainers 112 and 114 or the linear gears may be reversed, such that the shaft may be turned in a clockwise direction to pull the retainers towards each other. As the shaft 130 turns in the anti-clockwise direction in the embodiment illustrated, the first pinion gear 132 (and the second pinion gear 134, in some embodiments) also rotates in the anti-clockwise direction. As the first pinion gear 132 is engaged with the first linear gear 164*a*, the anti-clockwise rotation of the first pinion gear 132 causes the first linear gear arm 162*a* to move in a direction indicated by the arrow A (in the direction of the positive y-axis). Furthermore, as the first pinion gear 132 is also engaged with the third linear gear 184*a*, the anti-clockwise rotation of the first pinion gear 132 causes the third linear gear arm 182*a* to move in the direction indicated by the arrow B (i.e., in the direction of the negative y-axis). This causes the first retainer 112 to also move in the direction of the arrow A and the second retainer 114 to move in the direction of the arrow B. That is, the first retainer 112 and the second retainer 114 move closer towards each other by sliding over the rails 148*a* and 148*b* of the cutting bed 110. It should be noted that the as the first and the second retainers 112 and 114 move closer to each other, the first recess 166*a* provides room for the third linear gear arm 182*a* to move under the first retainer 112, thus avoiding impeding the motion of the third linear arm 182*a* and the second retainer 114 as a whole.

In the embodiment illustrated, moving the first and the second retainers 112 and 114 apart can be achieved by rotating the shaft 130 in the clock-wise direction. Rotating the shaft in the clockwise direction causes the first pinion 132 to also rotate in the clock-wise direction. This results in the first linear gear arm 162*a* and the first retainer 112 moving in a direction that is opposite to that indicated by the arrow B (i.e., in the direction of the negative y-axis). At the same time, the third linear gear arm 182*a* and the second retainer 114 would move in a direction that opposite to that indicated by the arrow A (i.e., in the direction of the positive y-axis). This would result in the first and the second retainers 112 and 114 being pulled away from each other. In other embodiments as discussed above, the orientations of the first retainer and second retainer may be reversed, and the shaft may be rotated in a counter-clockwise direction to move the retainers apart.

In some implementations, the gear mechanism 200 can be configured to have independent gear mechanisms associated with the first pinion 132 and the second pinion 134. Specifically, while the gear mechanism 200 shown in FIG. 7 includes a single shaft 130 attached to both the first and the second pinions 132 and 134, in some implementations, two separate shafts—one attached to the first pinion 132 and the other attached to the second pinion 134—can be employed. In some such implementations, the cutting device can include two knobs, levers, thumbscrews, or other mechanisms, with one at each end of the lower portion 102. In other embodiments, as discussed above, a gear mechanism 200 may not be utilized; rather, the first retainer and second retainer may be manually positioned, such as in slots for predetermined pill diameters, or slidingly positioned and fixed via set screws, retaining pins, shims, or other such mechanisms.

In some implementations, various components of the cutting device 110 can be manufactured using materials such as, but not limited to, wood, plastic, various steels, aluminum, tin, metal, metal alloys, etc. In some implementations, the cutting blade 106 can be manufactured using materials such as, but not limited to, stainless steel, steel, carbon steel, tool steel, alloy steel, cobalt and titanium alloys, ceramics, plastic, etc.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower," "front" and "rear," "top" and "bottom" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. The separation of various components in the implementations described above should not be understood as requiring such separation in all implementations, and it should be understood that the described components can generally be integrated together in a single component or divided into multiple components. Additionally, other implementations are within the scope of the following claims.

What is claimed is:

1. A multiple pill cutting device, comprising:

a lower portion comprising a cutting bed, a first pill retainer comprising at least one linear gear, and a second pill retainer parallel to the first pill retainer comprising at least another linear gear, oriented in opposition to the at least one linear gear of the first pill retainer;

at least one pinion gear configured to engage the at least one linear gear of the first pill retainer and engage the at least another linear gear of the second pill retainer at a point 180 degrees around the pinion gear from the first at least one linear gear of the first pill retainer;

an upper portion pivotally attached to a first end of the lower portion;

a knob connected to the at least one pinion gear disposed at a second end of the lower potion wherein the knob can be turned in a clockwise or anti-clockwise direction such that the first and second retainers are slidably drawn towards or away from each other; and a pill cutting blade attached to the upper portion; and wherein the first pill retainer is longer than the second pill retainer and extends beyond the at least another linear gear of the second pill retainer.

2. The multiple pill cutting device of claim 1, wherein the pill cutting blade is centered within the upper portion.

3. The multiple pill cutting device of claim 1, wherein the lower portion further comprises an axle attached to the pinion gear.

4. The multiple pill cutting device of claim 3, further comprising a closing lever attached to the axle.

5. The multiple pill cutting device of claim 3, wherein the axle extends at least the length of the cutting bed.

6. The multiple pill cutting device of claim 5, wherein the pinion gear is positioned at one end of the cutting bed; and further comprising a second pinion gear attached to the axle at an opposing end of the cutting bed.

7. The multiple pill cutting device of claim 6, wherein the first pill retainer comprises a third linear gear configured to engage the second pinion gear.

8. The multiple pill cutting device of claim 7, wherein the second pill retainer comprises a fourth linear gear, oriented in opposition to the third linear gear of the first pill retainer, and configured to engage the second pinion gear at a point 180 degrees from the linear gear of the first pill retainer.

9. The multiple pill cutting device of claim 1, wherein the cutting bed comprises a rubberized material.

10. A multiple pill cutting device, comprising:

a lower portion comprising a cutting bed;

a first pinion gear positioned at one end of the cutting bed;

an axle attached to the first pinion gear, extending at least the length of the cutting bed;

a second pinion gear attached to the axle at an opposing end of the cutting bed from the first pinion gear;

a first pill retainer comprising a first linear gear configured to engage the first pinion gear and a second linear gear configured to engage the second pinion gear;

a second pill retainer parallel to the first pill retainer comprising a third linear gear configured to engage the first pinion gear at a point 180 degrees from the first linear gear of the first pill retainer, and a fourth linear gear configured to engage the second pinion gear at a point 180 degrees from the second linear gear of the first pill retainer;

an upper portion pivotally attached to a first end of the lower portion; a knob connected to the first one pinion gear disposed at a second end of the lower potion wherein the knob can be turned in a clockwise or anti-clockwise direction such that the first and second retainers are slidably drawn towards or away from each other; and a pill cutting blade attached to the upper portion.

11. The multiple pill cutting device of claim 10, wherein the pill cutting blade is centered within the upper portion.

12. The multiple pill cutting device of claim 10, wherein the first pill retainer is longer than the second pill retainer.

13. The multiple pill cutting device of claim 10, wherein the first pill retainer extends beyond the third linear gear of the second pill retainer.

* * * * *